US005291538A

United States Patent [19]

Burke et al.

[11] Patent Number: 5,291,538

[45] Date of Patent: Mar. 1, 1994

[54] X-RAY TUBE WITH FERRITE CORE FILAMENT TRANSFORMER

[75] Inventors: James E. Burke, Villa Park; Lester Miller, Forest Park; Salvatore G. Perno, Winfield, all of Ill.

[73] Assignee: Picker International. Inc., Highland Hts., Ohio

[21] Appl. No.: 72,400

[22] Filed: Jun. 3, 1993

Related U.S. Application Data

[63] Continuation of Ser. No. 817,296, Jan. 6, 1992, abandoned.

[51] Int. Cl.[5] ..... H01J 35/04

[52] U.S. Cl. ..... 378/135; 378/134; 378/136

[58] Field of Search ..... 378/119, 121, 125, 131, 378/132, 134, 135, 136, 91, 101

[56] References Cited

U.S. PATENT DOCUMENTS

| | | | |
|---|---|---|---|
| 2,111,412 | 3/1938 | Ungelenk | 250/35 |
| 3,852,605 | 12/1974 | Watanabe et al. | 250/401 |
| 4,045,672 | 8/1977 | Watanabe | 250/360 |
| 4,068,127 | 10/1978 | Goodenough | 250/402 |
| 4,071,768 | 1/1978 | Goodenough | 250/444 |
| 4,199,684 | 4/1980 | Leunbach et al. | 250/402 |
| 4,206,356 | 6/1980 | Wardley et al. | 250/402 |
| 4,221,969 | 9/1980 | Schmidt | 250/421 |
| 4,250,425 | 2/1981 | Gabbay et al. | 313/60 |
| 4,323,781 | 4/1982 | Baumann et al. | 250/422 |
| 4,417,171 | 11/1983 | Schmitmann | 313/16 |
| 4,521,900 | 6/1985 | Rand | 378/137 |
| 4,769,831 | 9/1988 | Broenner | 378/125 |
| 4,788,705 | 11/1988 | Anderson | 378/121 |
| 4,869,257 | 9/1989 | Molnar et al. | 128/660.1 |
| 4,878,235 | 10/1989 | Anderson | 378/136 |
| 4,914,681 | 4/1990 | Klinenbeck, et al. | 378/12 |
| 5,046,186 | 9/1991 | Rohmfeld | 378/125 |
| 5,090,048 | 2/1992 | Blake | 378/202 |

FOREIGN PATENT DOCUMENTS

| | | |
|---|---|---|
| 0187020 | 7/1986 | European Pat. Off. . |
| 0377534 | 7/1990 | European Pat. Off. . |
| 3213644 | 10/1983 | Fed. Rep. of Germany . |
| 4004013 | 8/1991 | Fed. Rep. of Germany . |
| 61-061356 | 3/1986 | Japan . |

*Primary Examiner*—David P. Porta

*Attorney, Agent, or Firm*—Fay, Sharpe, Beall, Fagan, Minnich & Mckee

[57] ABSTRACT

An evacuated envelope (C) which is connected with an anode (A), has a cathode assembly (B) rotatably mounted inside. Magnets (44, 46) hold the cathode assembly stationary as the anode and envelope rotate. A ferrite core transformer (60) includes a ferrite core primary (66) stationarily mounted exterior to the envelope. A secondary (64) is mounted to the cathode assembly interior to the envelope. The secondary winding includes a ferrite core (70), a portion of which is surrounded by a ceramic, dielectric bobbin (76). The bobbin includes walls or ridges (78) which define a spiral groove (80) therearound in which an uninsulated electric wire (82) is received. The uninsulated electric wire is connected with a cathode filament (52). The primary winding has a ferrite core (90) that has about five times the cross section as the secondary ferrite core to compensate for a low, about 20%, coupling efficiency between the primary and secondary windings. Preferably, the primary winding core tapers (94) adjacent its pole faces to focus magnetic flux toward pole faces (72, 74) of the secondary ferrite core.

20 Claims, 3 Drawing Sheets

X-RAY TUBE WITH FERRITE CORE FILAMENT TRANSFORMER

This is a continuation of application Ser. No. 07/817,296, filed Jan. 6, 1992 now abandoned.

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes a cathode filament through which a current of about 5 amps is passed at a voltage sufficient to provide about 75 watts of power. This current heats the filament sufficiently that it is caused to emit a cloud of electrons, i.e. thermionic emission. A high potential on the order of 100 kV is applied between the cathode and the anode. This potential causes the electrons to flow between the cathode and the anode through the evacuated region in the interior of the envelope. Generally, this electron beam or current is on the order of 10–500 mA. The electron beam impinges on the anode generating x-rays and producing extreme heating as a byproduct. In high energy x-ray tubes, the anode is rotated at high speeds such that the electron beam does not dwell on only a small area of the anode causing thermal deformation. Each spot on the anode which is heated by the electron beam cools substantially during one rotation of the anode before it is again heated by the electron beam. Larger diameter anodes have a larger circumference, hence provide greater thermal loading. In most conventional rotating anode x-ray tubes, the envelope and the cathode remain stationary while the anode rotates inside the envelope. Heat from the anode is dissipated by thermal radiation through the vacuum to the exterior of the envelope.

High power x-ray tubes have been proposed in which the anode and vacuum envelope rotate, while the cathode filament inside the envelope remains stationary. This configuration permits a coolant fluid to be circulated to the anode to provide a direct thermal connection between the anode and the exterior of the envelope. See for example, U.S. Pat. Nos. 4,788,705 and 4,878,235. One of the difficulties with this configuration is providing electrical energy to the stationary cathode within the rotating vacuum envelope. Conveying 5 amps of power into an evacuated envelope without degrading the vacuum can be achieved by using an air core coil or an air core transformer as illustrated by the above-referenced patents. One drawback of the air core coil or transformer configurations is that any vibration of the cathode structure induces changes in the magnetic flux linking the external primary and the internal secondary. These vibration induced changes in the flux linkage cause corresponding variations in the filament current, leading to erratic filament emission. Another drawback to these patents is that the air core coil or transformer operates at about 13.56 MHz which corresponds to a skin depth in copper of about 0.024 mm. Because the electrical current is constrained to such a shallow skin depth, problems arise in the design of the low-resistance leads to the filament, as well as to localized hot spots on the filament itself. Additionally, when multiple secondary turns are provided, wire insulation systems present serious problems with respect to vacuum outgasing and particles.

The present invention provides a new and improved technique for transferring electrical power to the filament of an x-ray tube in which there is relative rotational movement between the envelope and the cathode.

SUMMARY OF THE INVENTION

In accordance with the present invention, an x-ray tube is provided in which an evacuated envelope and a filament contained therein undergo relative rotational movement. A ferrite core transformer conveys electrical power from an AC source across the envelope to the filament disposed in the interior of the envelope.

In accordance with a more limited aspect of the present invention, the ferrite core of a primary winding disposed outside the envelope is of a significantly larger cross-section than the ferrite core of a secondary winding disposed within the envelope.

In accordance with another aspect of the present invention, the secondary winding is not coated with electrical insulation. Rather, the secondary winding is wound in grooves of an insulative bobbin, which insulative bobbin electrically insulates the uninsulated turns.

In accordance with another aspect of the present invention, the cathode and an anode are held at a relatively high potential difference. The primary and secondary windings of the ferrite core transformer are held substantially at the potential of the cathode. An isolation transformer is provided between the primary winding and an AC current source to isolate the ferrite core transformer from other circuitry.

In accordance with another aspect of the present invention, the primary winding is connected with a relatively low frequency AC source, in the KHz range.

In accordance with another aspect of the present invention, a plurality of filaments are provided, each connected with a different secondary winding.

In accordance with another aspect of the present invention, a plurality of filaments are connected with a common secondary winding. Switching means controllable from exterior to the envelope are provided for selecting which of the filaments receives electrical potential from the secondary winding 150.

One advantage of the present invention resides in its stability.

Another advantage of the present invention resides in its simplicity.

The present invention is also more cost efficient than the prior art.

Still further advantages of the present invention will be come apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangement of steps. The drawings are only for purposes of illustrating a preferred embodiment and are not to be construed as limiting the invention.

DETAILED DESCRIPTION OF THE PREFERRED EMBODIMENTS

Figure 1:
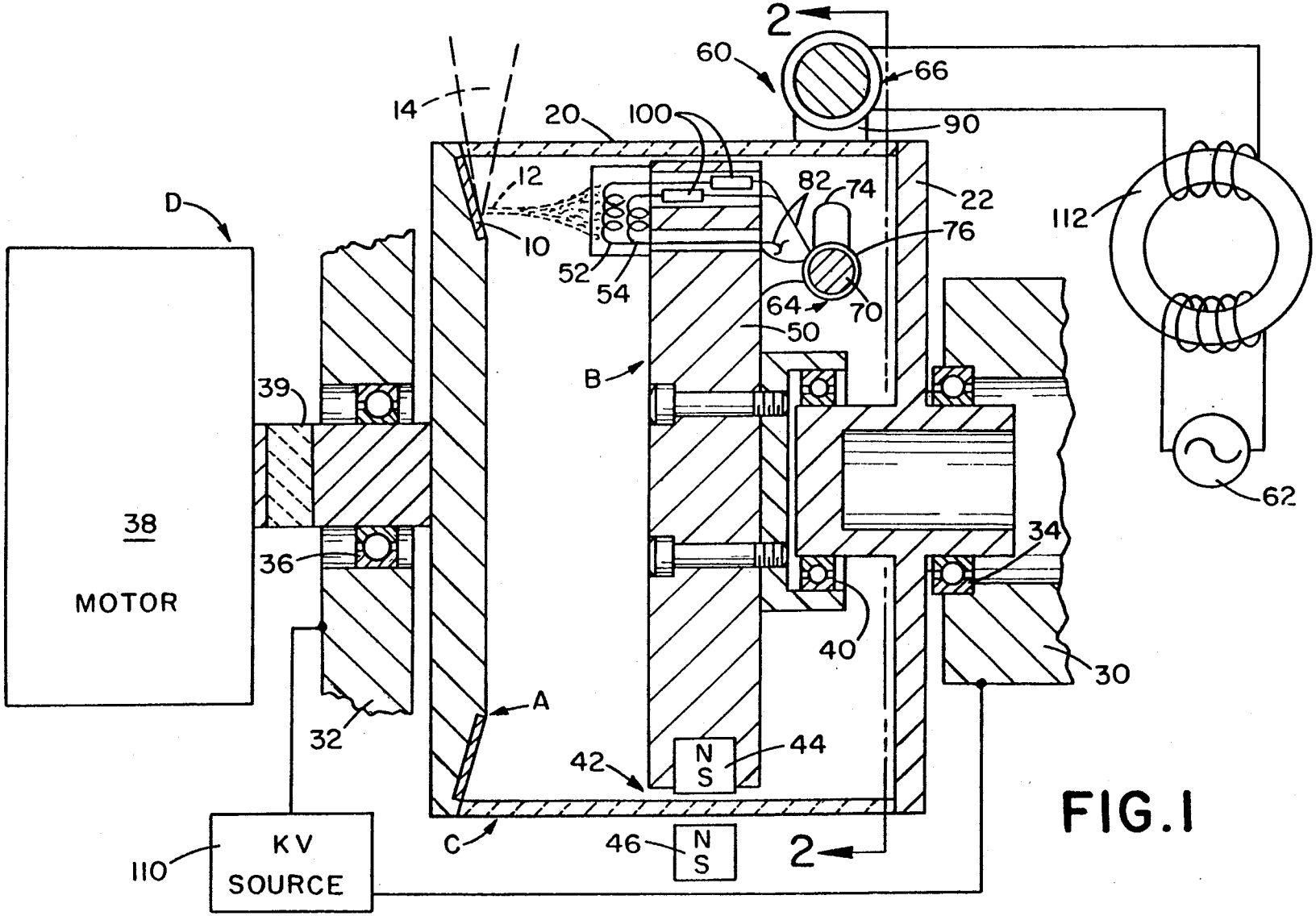
FIG. 1 is a longitudinal cross-section of an x-ray tube in accordance with the present invention.

With reference to FIG. 1, an x-ray tube includes a anode A and a cathode assembly B. An evacuated envelope C is evacuated such that an electron beam 12 passing from the cathode to the anode passes through a vacuum. A rotating means D enables the anode A and the envelope c to undergo rotational movement relative to the cathode assembly B.

The anode A has a beveled, annular anode surface 10 which is bombarded by the electron beam 12 from the cathode assembly B to generate a beam 14 of x-rays. The entire anode may be machined from a single piece of tungsten. Alternatively, the beveled, peripheral anode path 10 may be an annular strip of tungsten which is connected to a highly thermally conductive disk or plate. Typically, the anode and envelope are immersed in an oil-based dielectric fluid which is circulated to a cooling means. In order to keep the face of the anode surface 10 cool, portions of the anode between the cooling fluid should be highly thermally conductive.

The anode A forms one end of the vacuum envelope C. A ceramic cylinder 20 is connected between the anode A and an opposite or cathode end plate 22. At least an annular portion of the cylinder 20 closely adjacent to the anode is x-ray transparent to provide a window from which the x-ray beam 14 is emitted. Preferably, the cylinder 20 is constructed at least in part of a dielectric material such that a high voltage differential can be maintained between anode A and the end plate 22. In the preferred embodiment, the end plate 22 is biased to the potential of the cathode assembly B, generally about 100 kV or more negative than the anode.

The rotation means D includes stationary mounting portions 30, 32. A first bearing 34 interconnects the first stationary portion 30 and the end plate 22. A second bearing 36 interconnects the second stationary portion 32 and the anode A. A motor 38 rotates the anode and envelope combination relative to the stationary portions 30, 32. An isolation drive coupler 39 electrically isolates the motor 38 from the anode A. A greaseless bearing 40 is mounted between the cathode assembly B and the envelope C to enable the envelope and the cathode to rotate relative to each other. A means 42 holds the cathode assembly B stationary relative to the rotating envelope C. In the preferred embodiment, the means 42 includes an array of magnets represented here by a pair of magnets 44, 46. Magnet 44 is mounted to the cathode assembly and magnet 46 is mounted to a stationary structure outside of the envelope C. The magnets are mounted with opposite poles towards each other such that the stationary magnet 46 holds magnet 44 and the cathode assembly stationary as the envelope C and the anode A rotate.

The cathode assembly B includes a cathode mounting plate 50 which is mounted on an outer race of the cathode bearing 40. The cathode plate supports a first or larger thermionic filament means $2 and a second or smaller thermionic filament means $4. One of the large and small filaments selectively receives sufficient electric current that it is heated to a temperature at which electrons are emitted. Optionally, additional coils, plates, or other electronics (not shown) may be mounted adjacent the filaments to focus the beam 12. The filaments and any focusing electronics are connected with a ferrite core transformer means 60 for communicating electrical power from an AC electrical power supply 62 exterior to the envelope C to the cathode filaments in the evacuated interior of the envelope.

Figure 2:
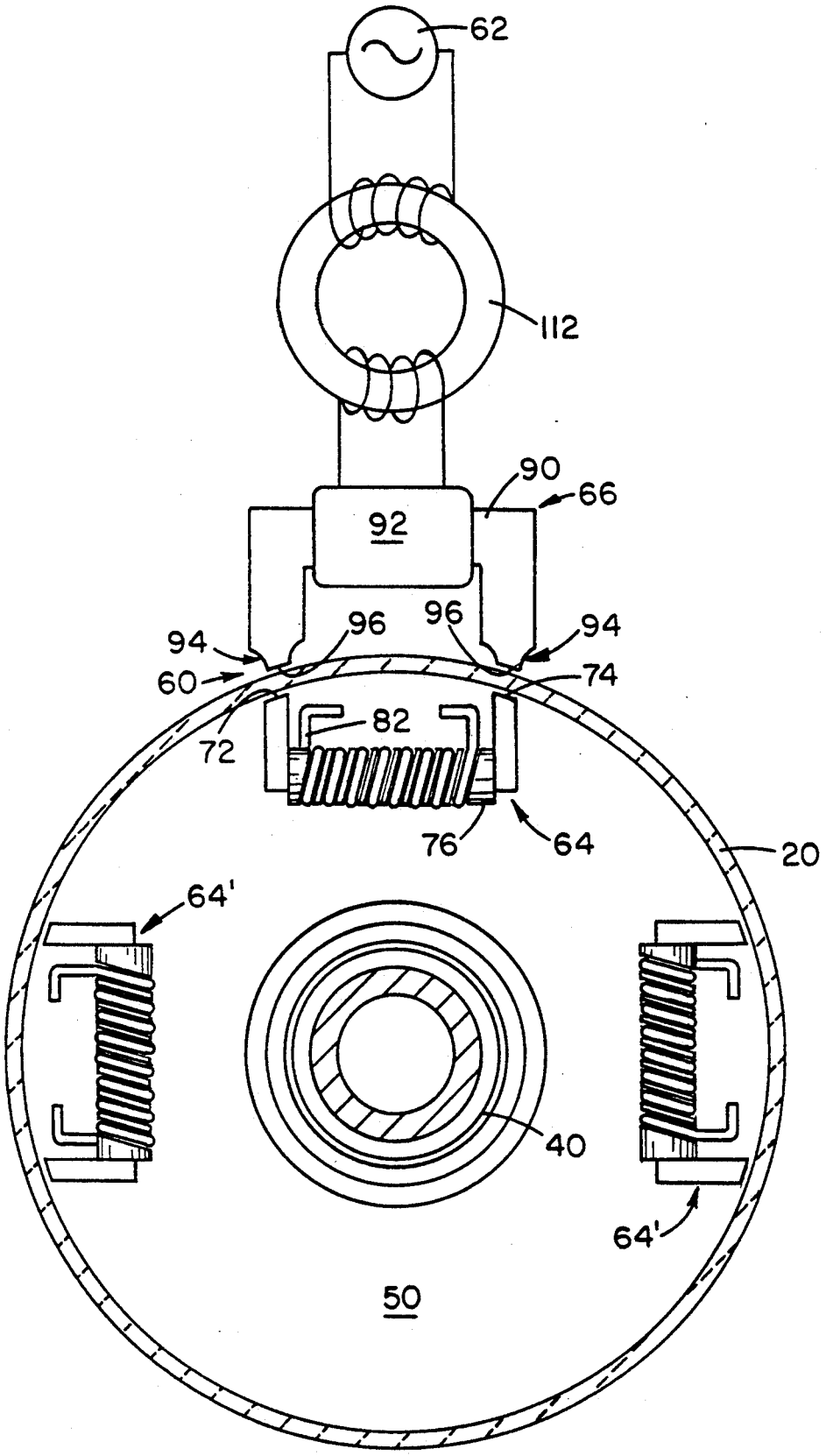
FIG. 2 is a transverse sectional view through sections 2—2 of the filament transformer assembly of FIG. 1.
Figure 3:
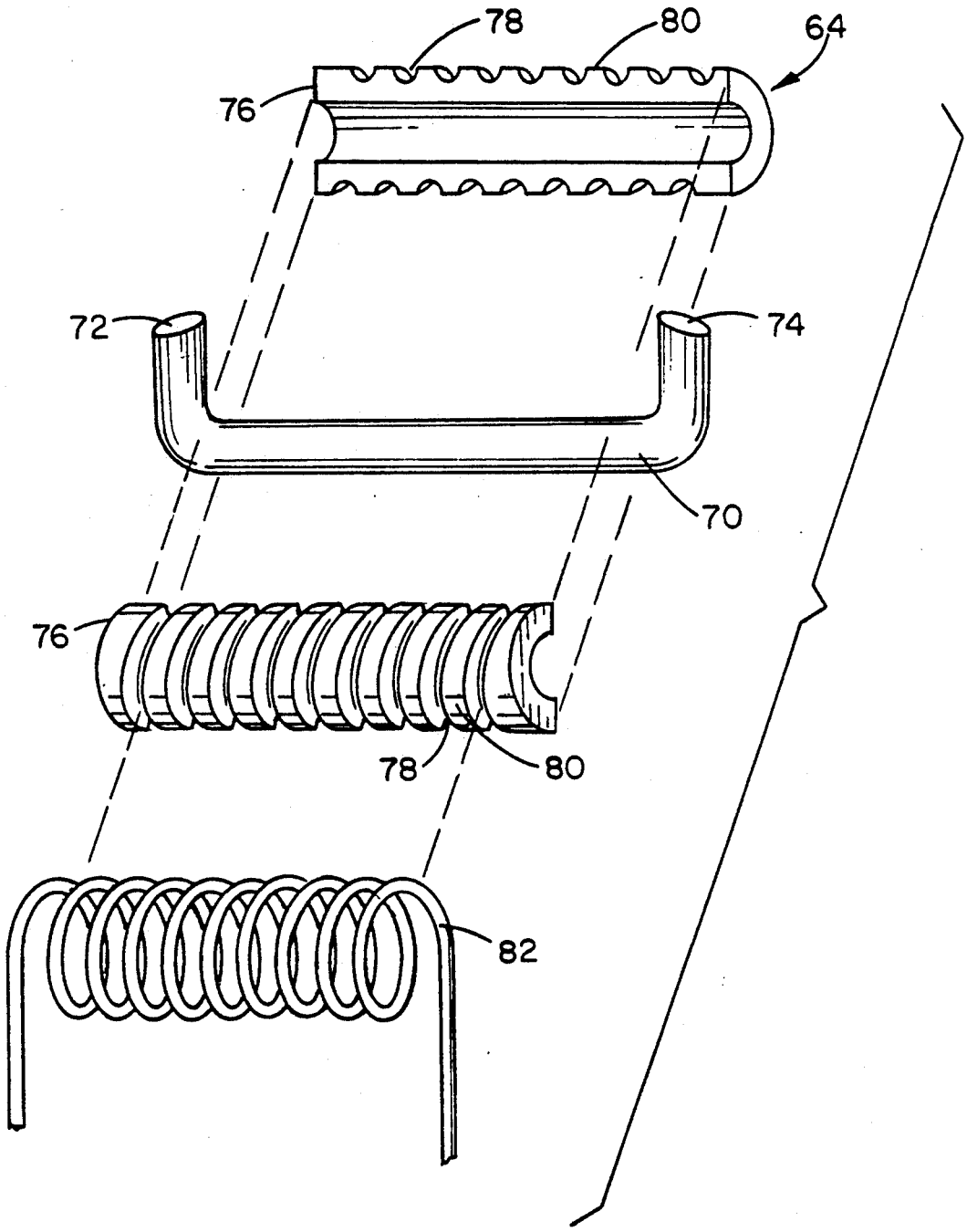
FIG. 3 is an exploded view illustrating the secondary winding of one of the ferrite core transformers of FIG. 2.

With continued reference to FIG. 1 and further reference to FIGS. 2 and 3, the ferrite core transformer means 60 includes a secondary 64 interior to the envelope and a primary 66 exterior to the envelope. The interior secondary 64 includes a generally U-shaped ferrite core 70 having pole faces 72, 74 which are shaped for close, noninterfering conformity with the circularly cylindrical shape of the cylinder 20. The ferrite core material, a nickel-zinc/magnesium-zinc alloy, is vacuum compatible to temperatures up to about 500° C. A ceramic bobbin 76 is disposed around a central portion of the ferrite core 70. The bobbin 76 defines a spiral groove 78 which are separated by a spiral divider 80. An uninsulated copper wire 82 is wound in the groove 78. The width of the divider wall so is selected relative to the dielectric properties of the ceramic bobbin 76 such that the current carried by the secondary winding 82, on the order of 5 amps in the preferred embodiment, does not arc. In the embodiment illustrated in FIG. 3, the bobbin is shown as being constructed in two halves. Alternately, the ferrite core 70 may be constructed in multiple parts to permit receipt of a single piece, cylindrical bobbin. As another alternative, because vacuum is a relatively good electrical insulator, the bobbin surface may define wire winding guides rather than the complete divide wall 80. The winding guides, e.g. dielectric pins assist in configuring the windings with sufficient spacing to prevent arcing. Optionally, larger diameter bobbins may be mounted over prior layers of wire windings wrapped about smaller diameter bobbins to obtain multiple layers of wire windings.

The primary 66 includes a generally U-shaped ferrous core member 90 around which a primary wire winding 92 is wrapped. The ferrous core member 90 is substantially larger in diameter than the ferrous core member 70 of the secondary. The flux coupling efficiency between the primary and secondary is relatively low, on the order of 20%. Accordingly, the primary is configured to generate about five times the flux that would saturate the secondary before it saturates. This enables the primary to be driven up to the point of saturation of the secondary before it saturates. Moreover, having larger diameter pole faces simplifies aligning of the primary and secondary. Alternatively, the pole faces of the primary core are tapered 94 to focus the magnetic flux towards a smaller face 96 which is more similar in size to the secondary pole faces 72, 74.

To accommodate multiple filaments and focusing plates or electronics, additional secondarys 64' are provided. The primary 66 can be rotated from secondary to secondary to assure that only a single filament is powered at a time. Additional filaments may be mounted at regular angular intervals around plate 50 to provide backup filaments should one filament burn out. As these filaments are rotated to the operating position, the corresponding secondary is rotated concurrently into alignment with the primary. As yet another alternative, a switching means 100 may interconnect a plurality of filaments to a common secondary winding. The switching means 100, such as reed switches, tuned filters, or the like are controllable from exterior of the vacuum envelope 20 to connect a selected cathode filament(s) to the secondary winding. In another embodiment, two or more separate primary windings, disposed outside of the envelope, are magnetically coupled to a like number of separate secondary windings disposed within the envelope. The secondary windings are each operatively connected to separate cathode filaments disposed within the common cathode assembly B, such as filaments 52 and 54. In this manner, an alternate means is provided for actuating one or more cathode filaments simultaneously or independently.

A high voltage source 110 applies a high voltage across the anode A and cathode B. Typically, the high voltage is on the order of 150 kV. The secondary 64 which is mounted to the cathode assembly plate 50 has substantially the same potential as the cathode. An isolation transformer 112 is provided between the primary 66 and the AC source 62 in order to permit voltage isolation of the primary from other associated circuitry. This enables the primary and secondary both to be biased to the cathode potential for optimum transformer performance.

The invention has been described with reference to the preferred embodiments. Obviously, modifications and alternations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. In an x-ray tube which includes an evacuated envelope, a cathode assembly and an anode surface disposed within the evacuated envelope, and a means for permitting relative rotational movement between the cathode assembly and the envelope, the improvement comprising:

a plurality of secondary windings disposed around a plurality of secondary cores disposed within the evacuated envelope, the plurality of secondary windings being connected with a plurality of thermionic cathode means for emitting electrons in response to electrical stimulation;

a primary winding with a primary core disposed exterior to the evacuated envelope, the primary core being selectively positionable across the envelope from and in a magnetic flux coupled relationship with each of the secondary cores.

2. In an x-ray tube which includes an evacuated envelope, a cathode assembly and an anode surface disposed within the evacuated envelope, the cathode assembly including a thermionic cathode means which emits electrons in response to electrical stimulation, and a means for permitting relative rotational movement between the cathode assembly and the envelope, the improvement comprising:

a secondary winding with a ferrite core disposed within the evacuated envelope, the secondary winding being connected with the thermionic cathode means;

a ceramic, dielectric bobbin surrounding at least a portion of the secondary ferrite core, the secondary winding including an uninsulated wire wrapped in a spiral around the bobbin;

a primary winding with a ferrite core disposed exterior to the evacuated envelope, the primary ferrite core being mounted across the envelope from and in a magnetic flux coupled relationship with the secondary ferrite core.

3. In the x-ray tube as set forth in claim 2, the improvement further comprising:

the bobbin defining a spiral groove within which the uninsulated wire is received and a ceramic, dielectric wall separating adjacent turns of the uninsulated wire.

4. In the x-ray tube as set forth in claim 2, the improvement further comprising:

the primary ferrite core being substantially larger in transverse cross-section than the secondary winding ferrite core.

5. In the x-ray tube as set forth in claim 2 in which a high voltage means creates a high potential between the anode and cathode assembly, the improvement further comprising:

the secondary winding being mounted to the cathode assembly and held at substantially the potential thereof, the primary winding being at substantially the same potential as the secondary winding; and, an isolating transformer for isolating the primary winding from an AC electric source, whereby the potential of the primary and secondary windings is isolated from the AC source.

6. In an x-ray tube which includes an evacuated envelope, a cathode assembly and an anode surface disposed within the evacuated envelope, the cathode assembly including a thermionic cathode means which emits electrons in response to electrical stimulation, and a means for permitting relative rotational movement between the cathode assembly and the envelope, the improvement comprising:

a secondary winding with a ferrite core disposed within the evacuated envelope, the secondary winding being connected with thermionic cathode means;

a primary winding with a ferrite core disposed exterior to the evacuated envelope, the primary ferrite core being mounted across the envelope from and in a magnetic flux coupled relationship with the secondary ferrite core, the primary ferrite core being larger in transverse cross-section than the secondary winding ferrite core.

7. In an x-ray tube which includes an evacuated envelope, a cathode assembly and an anode surface disposed within the evacuated envelope, the cathode assembly including a thermionic cathode means which emits electrons in response to electrical stimulation, a means for permitting relative rotational movement between the cathode assembly and the envelope, and a high voltage means for creating a high potential between the anode and cathode assembly, the improvement comprising:

a secondary winding with a ferrite core mounted to the cathode assembly within the evacuated envelope and held at substantially the potential thereof, the secondary winding being connected with the thermionic cathode means;

a primary winding with a ferrite core disposed exterior to the evacuated envelope, the primary ferrite core being mounted across the envelope from and in a magnetic flux coupled relationship with the secondary ferrite core, the primary winding being at substantially the same potential as the secondary winding; and an isolating transformer for isolating the primary winding from an AC electric source.

8. A rotating anode x-ray tube comprising:

an evacuated envelope having a vacuum in an interior thereof;

an anode formed at least along an annular surface adjacent one end of the envelope;

a cathode assembly rotatably supported by the envelope, the cathode assembly including a cathode means for emitting electrons in response to electrical stimulation;

a means for rotating the envelope and anode;

a means for holding the cathode assembly stationary as the envelope and anode rotate;

a ferrite core transformer having (i) a primary winding and a C-shaped primary ferrite core exterior of the envelope, the primary ferrite core extending between end faces disposed contiguous to and conforming with an exterior surface of the envelope and (ii) and a secondary winding and a C-shaped secondary ferrite core extending between end faces disposed in the vacuum interior of the envelope, the primary and secondary core end faces being disposed sufficiently contiguous to each other that magnetic flux from the primary ferrite core is communicated to the secondary ferrite core, the secondary ferrite core, the secondary winding being connected with the cathode assembly for providing an AC electrical current path to the cathode assembly.

9. A rotating anode x-ray tube comprising:

an evacuated envelope;

an anode formed at least along an annular surface adjacent one end of the envelope;

a cathode assembly rotatably supported by the envelope, the cathode assembly including a plurality of filaments for emitting electrons in response to electrical stimulation;

a means for rotating the envelope and anode;

a means for holding the cathode assembly stationary as the envelope and anode rotate;

a ferrite core transformer having (i) a primary winding and a primary ferrite core exterior of the envelope and (ii) a plurality of secondary ferrite cores mounted to the cathode assembly in an interior of the envelope, each filament being connected with one of a plurality of secondary windings which each encircle one of the ferrite cores mounted to the cathode assembly inside the envelope.

10. A rotating anode x-ray tube comprising:

an evacuated envelope;

an anode formed at least along an annular surface adjacent one end of the envelope;

a cathode assembly rotatably supported by the envelope, the cathode assembly including a cathode means for emitting electrons in response to electrical stimulation;

a means for rotating the envelope and anode;

a means for holding the cathode assembly stationary as the envelope and anode rotate;

a primary winding and a primary ferrite core exterior of the envelope;

a secondary ferrite core having at least one end face which conforms to an interior surface of the envelope in a close, magnetic flux coupled relationship with the primary ferrite core;

a dielectric member surrounds at least a portion of the secondary ferrite core;

a secondary winding including an insulation free wire wound around the dielectric member in a spiral path with spaced turns, the uninsulated wire being connected with the cathode assembly.

11. The x-ray tube as set forth in claim 10 wherein the dielectric member further includes a dielectric means disposed between adjacent spiral turns of the uninsulated wire to constrain adjacent turns of the uninsulated wire to a spaced relationship to prevent arcing.

12. The x-ray tube as set forth in claim 10 wherein:

the secondary ferrite core extends between end faces which are disposed contiguous to and conform with an interior surface of the envelope;

the primary ferrite core extends between end faces disposed contiguous to and conforming with an exterior surface of the envelope, the first and second ferrite core end faces being disposed sufficiently contiguous to each other that magnetic flux from the primary ferrite core is communicated to the secondary ferrite core;

the primary ferrite core having a transverse cross-section which is larger than a transverse cross-section of the secondary ferrite core.

13. The x-ray tube as set forth in claim 10 wherein:

the secondary ferrite core extends between end faces which are disposed contiguous to and conform with an interior surface of the envelope;

the primary winding includes a ferrite core with end faces disposed contiguous to and conforming with an exterior surface of the envelope, the first and second ferrite core end faces being disposed sufficiently contiguous to each other that magnetic flux from the primary ferrite core is communicated to the secondary ferrite core;

the primary ferrite core having a transverse cross-section which is at least twice a transverse cross-section of the secondary ferrite core.

14. An x-ray tube comprising:

an evacuated envelope having a circularly cylindrical side wall;

an anode formed at least along an annular surface adjacent one end of the envelope;

a cathode assembly rotatably supported relative to the envelope, the cathode assembly including a thermionic cathode means for emitting electrons in response to electrical stimulation;

a transformer having:

a primary winding encircling a C-shaped primary core exterior of the envelope, the primary core having end faces disposed contiguous to and conforming with an exterior surface of the envelope side wall, a secondary winding encircling a C-shaped secondary core interior to the envelope, the secondary core having end faces disposed contiguous to and conforming to an interior surface of the envelope side wall, the primary and secondary core end faces being disposed sufficiently contiguous to each other that magnetic flux from the primary core is communicated across the envelope side wall to the secondary core, the secondary winding being connected with the thermionic cathode means.

15. An x-ray tube as set forth in claim 14 comprising:

an evacuated envelope;

an anode formed at least along an annular surface adjacent one end of the envelope;

a cathode assembly rotatably supported relative to the envelope, the cathode assembly including a plurality of thermionic cathode means for emitting electrons in response to electrical stimulation;

a primary winding encircling a primary ferrite core exterior of the envelope;

a plurality of ferrite core secondary windings mounted to the cathode assembly inside the envelope, each thermionic cathode means being connected with a corresponding secondary winding.

16. An x-ray tube as set forth in claim 14 further including comprising:

an evacuated envelope;

an anode formed at least along an annular surface adjacent one end of the envelope;

a cathode assembly rotatably supported within the envelope, the cathode assembly including a plurality of thermionic cathode means for emitting electrons in response to electrical stimulation;

a ferrite core transformer having a primary winding encircling a primary core exterior of the envelope and a secondary winding encircling a secondary ferrite core interior of the envelope, the primary and secondary cores being disposed sufficiently contiguous to each other that magnetic flux from the primary core is communicated to the secondary core;

a switching means disposed means disposed within the evacuated envelope for selectively connecting each of the thermionic cathode means with the secondary winding.

17. The x-ray tube as set forth in claim 16 wherein the switching means includes a reed switch.

18. An x-ray tube comprising:

an evacuated envelope;

an anode formed at least along an annular surface adjacent one end of the envelope;

a cathode assembly rotatably supported by the envelope, the cathode assembly including a thermionic cathode means for emitting electrons in response to electrical stimulation;

a ferrite core transformer including:

a primary winding encircling a primary ferrite core exterior of the envelope;

a dielectric member surrounding at least a portion of a secondary ferrite core; and, a secondary winding including an insulation free wire wound around the dielectric member in a spiral path with spaced turns, the uninsulated wire being connected with the cathode means.

19. The x-ray tube as set forth in claim 18 wherein the dielectric member further includes a dielectric means disposed between adjacent turns of the uninsulated wire to constrain adjacent turns of the uninsulated wire to a spaced relationship.

20. An x-ray tube comprising:

an evacuated envelope;

an anode formed at least along an annular surface adjacent one end of the envelope;

a cathode assembly rotatably supported by the envelope, the cathode assembly including a thermionic cathode means for emitting electrons in response to electrical stimulation;

a ferrite core transformer having a primary winding encircling a primary ferrite core exterior of the envelope and a secondary winding encircling a secondary ferrite core interior of the envelope, the primary ferrite core having a transverse cross-section which is larger than a transverse cross-section of the secondary ferrite core, the primary ferrite core having end faces disposed contiguous to and conforming with an exterior surface of the envelope, the secondary ferrite core extending between end faces which conform to an interior of the envelope, the primary and secondary ferrite core end faces being disposed sufficiently contiguous to each other that magnetic flux from the primary ferrite core is communicated to the secondary ferrite core, the secondary winding being connected with the thermionic cathode means.

* * * * *